US010428488B2

(12) United States Patent
Allbright et al.

(10) Patent No.: US 10,428,488 B2
(45) Date of Patent: Oct. 1, 2019

(54) SUPPORT STRUCTURE OF A COVER

(71) Applicant: ACO SEVERIN AHLMANN GMBH & CO KOMMANDITGESELLSCHAFT, Büdelsdorf (DE)

(72) Inventors: Andrew Allbright, Northamptonshire (GB); James Canney, Bedfordshire (GB); Prasanna Kumar, Buedelsdorf (DE); Arne Meincke, Osdorf (DE)

(73) Assignee: ACO SEVERIN AHLMANN GMBH & CO. KG, Buedelsdorf (DE)

( * ) Notice: Subject to any disclaimer, the term of this patent is extended or adjusted under 35 U.S.C. 154(b) by 142 days.

(21) Appl. No.: 15/129,257

(22) PCT Filed: Apr. 2, 2015

(86) PCT No.: PCT/EP2015/057324
§ 371 (c)(1),
(2) Date: Sep. 26, 2016

(87) PCT Pub. No.: WO2015/150523
PCT Pub. Date: Oct. 8, 2015

(65) Prior Publication Data

US 2017/0107682 A1 Apr. 20, 2017

(30) Foreign Application Priority Data

Apr. 3, 2014 (DE) ..... 10 2014 104 744

(51) Int. Cl.
*E02D 29/14* (2006.01)

(52) U.S. Cl.
CPC ..... *E02D 29/14* (2013.01); *E02D 29/1454* (2013.01); *E02D 2200/1628* (2013.01); *E02D 2300/0031* (2013.01)

(58) Field of Classification Search
CPC ..... E02D 29/14
(Continued)

(56) References Cited

U.S. PATENT DOCUMENTS 1,548,767 A * 8/1925 Steele ..... E05B 65/0057 137/371
2,208,973 A * 7/1940 Gurney ..... E04B 7/102 52/20

(Continued)

FOREIGN PATENT DOCUMENTS

EP 1031664 8/2000
EP 1031664 A1 8/2000

(Continued)

OTHER PUBLICATIONS

The International Report on Patentability issued in corresponding International Patent Application No. PCT/EP2015/057324; dated Oct. 4, 2016.

(Continued)

*Primary Examiner* — Thomas B Will
*Assistant Examiner* — Katherine J Chu
(74) *Attorney, Agent, or Firm* — Pearne & Gordon LLP

(57) ABSTRACT

The invention relates to a support structure of a cover of a structure capable of being inserted into the ground, for example of a shaft or a channel, wherein the cover (10) comprises a traversable surface (11) and the support structure (20) extends downwards under said cover into the structure and comprises beam-shaped supports (21-23) such that their under support side (24) facing away from the surface (11) experiences a tensile stress when the surface (11) is loaded. The invention is further characterized in that between two areas (A, A') a thickness (D) of the carriers with minimum tensile stress is configured substantially symmetrically in an increasing manner up to a maximum value (Continued)

and then, in turn, in a decreasing manner to form a ball shape when viewing the cover from below.

7 Claims, 1 Drawing Sheet

(58) Field of Classification Search
USPC ..... 404/25, 26; 52/19, 20; 137/371; D23/260
See application file for complete search history.

(56) References Cited

U.S. PATENT DOCUMENTS 2,358,750 A * 9/1944 Walker ..... E02D 29/14 404/25
3,046,853 A * 7/1962 Legendre ..... E02D 29/14 220/284
3,920,347 A * 11/1975 Sauriol ..... E02D 29/124 210/166
4,861,186 A * 8/1989 Ferns ..... E02D 29/14 404/25
4,890,425 A * 1/1990 Mamula ..... E02D 31/02 52/169.5
4,973,191 A * 11/1990 Dannhauser ..... G09F 19/22 404/25
D350,814 S * 9/1994 Florence ..... D23/260
5,482,400 A * 1/1996 Bavington ..... E02D 29/12 404/25
5,911,537 A * 6/1999 Pulver ..... E02D 29/14 404/25
5,989,417 A * 11/1999 Fleischhacker ..... E03F 5/06 210/163
6,688,806 B2 2/2004 Kuan
6,702,723 B2 * 3/2004 Landfair ..... A63B 21/06 482/106
D576,257 S * 9/2008 Rattenbury ..... D23/260
D615,665 S * 5/2010 Berthon ..... D25/36
D629,874 S * 12/2010 Hermans ..... D23/260
8,469,628 B2 * 6/2013 Miller ..... E02D 29/14 404/25
9,004,809 B2 * 4/2015 Stoltenberg ..... E02D 29/14 404/25
2003/0039510 A1 2/2003 Kuan
2007/0223997 A1 * 9/2007 Fuchs ..... E02D 29/1427 404/25
2008/0028688 A1 * 2/2008 Neuber ..... E02D 29/1427 52/20
2009/0290934 A1 * 11/2009 Jordan ..... E02D 29/14 404/26

FOREIGN PATENT DOCUMENTS

WO 2005111318 A1 11/2005
WO 2013004688 A1 1/2013

OTHER PUBLICATIONS

The International Search Report issued in corresponding International Application No. PCT/EP2015/057324; dated Jun. 16, 2015.
The Decision to Grant issued in corresponding Russian Patent Application No. 2016143152; dated Jan. 31, 2018.

* cited by examiner

SUPPORT STRUCTURE OF A COVER

The invention relates to a support structure of a cover of a structure according to the preamble of patent claim 1.

Covers for structures that are capable of being inserted into the ground are known for instance from EP 1031664 A1 or DE 10 2011 051 545 A1. These known objects are so-called manhole covers. Please note, however, that the present invention also applies to support structures of rectangular covers, e.g. to covers of surface drainage channels, i.e. it follows that the covers can also have openings.

Covers of this type are frequently made of cast iron or plastic. To keep material consumption down, the covers are constructed of a surface-forming portion on the one hand, and of support structures to support this area on the other hand. The covers and their supporting structures known from the aforementioned documents are stable, but the material consumption is considerable.

The invention addresses the problem of further developing a support structure of the aforementioned type in such a manner that the same stability can be achieved at a reduced cost and amount of materials.

This problem is solved by a supporting structure according to claim 1 and a process for producing the same according to claim 5.

This problem is solved in particular for a support structure of a cover of a structure capable of being inserted into the ground, e.g. of a shaft or channel, wherein the cover comprises a traversable surface and the support structure extends downwards under said cover into the structure and comprises beam-shaped supports in such a manner that the lower support sides facing away from the surface are subject to a tensile stress when a load is applied to the surface, by substantially symmetrically configuring between two areas a thickness of the supports with minimum tensile stress in an increasing manner up to a maximum value and then, in turn, in a decreasing manner to form a spherical shape in a bottom view of the cover. I.e. the point is not that the support has larger height dimensions, i.e. is larger in the vertical direction, but in its thickness, resulting in a type of spindle shape in a horizontal section. It is of course possible to simultaneously combine this change in thickness with a change in height of the support structure.

The cover is preferably formed as an integral cast part, allowing for a very simple production. In particular, here the design as a spherulitic cast iron part, resulting in high stability, is preferred.

The thickness of the side surfaces of the support facing each other, which define the support, are preferably formed divergent towards the surface (i.e., in the installed state from the bottom upwards) for the formation of draft angles. The angle of inclination of these surfaces in this case remains constant over the entire length of the support; thus remains unchanged in the thinner regions of the support as compared to the thicker areas of the support. In this way, an optimum demolding of the forming model from the molding material (molding sand) is ensured.

Such a support structure can be dimensioned based on the following steps:

- A first thickness of the supports for bearing a predetermined load is determined by assuming a constant thickness over the length of the support;
- A second thickness of the supports in the areas of minimum tensile stress is determined for bearing the predetermined load based on a constant thickness over the length of the support; and

- The thickness of the supports is determined based on an increasing thickness from the second thickness to the first thickness and based on a decreasing thickness back to the second thickness. In doing so, care is taken to avoid abrupt transitions.

Below, two exemplary embodiments of the invention are explained in detail. In the figures.

In the following description, the same reference numerals are used for identical and identically acting parts.

Figure 1:
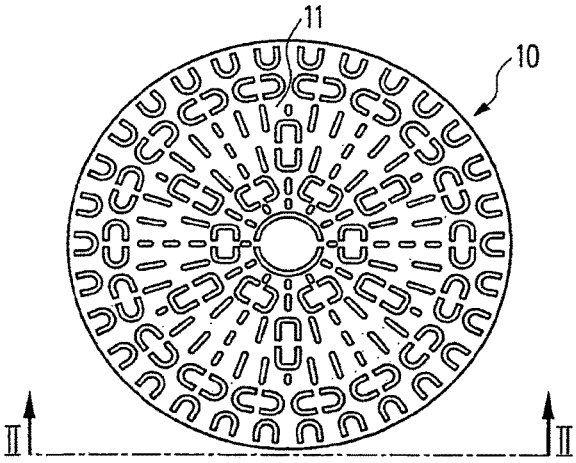
FIG. 1 shows a plan view of a cover.
Figure 3:
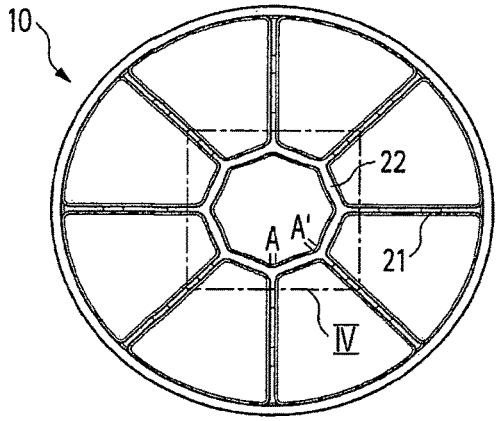
FIG. 3 shows a bottom view of the cover of FIGS. 1 and 2.
Figure 2:
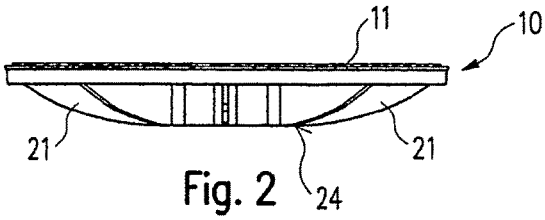
FIG. 2 shows a view along the line II-II of FIG. 1.
Figure 4:
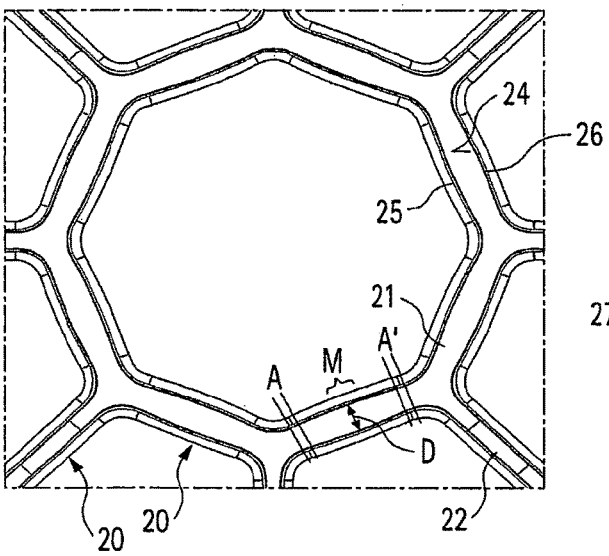
FIG. 4 shows an enlarged view of area IV in FIG. 3.

FIGS. 1-3 show a manhole cover made of ductile iron. This manhole cover comprises a support structure 20, which consists of eight radially extending supports 21, extending from an outer edge of the cover 10 inwards by an amount that is shorter than the radius. The height of the supports 21 rises—as can be seen particularly in FIG. 2—from the outer edge towards the inside and are interconnected at their inner ends by eight supports 23, arranged in a regular octagon. When a load acts vertically from above on the (built-in) cover 10, the inner supports 22 bear largely purely tensile loads transferred by the supports 21, in particular from their (in the installed state) bottom sides to the bottom sides 24 of the supports 22.

The relatively lowest tension acts on the supports 22 in the areas A, A', which are adjacent to the "coupling areas" at the ends of the supports 22. In a central area M between the areas A, A', the supports 21 now have a greater thickness D than in the areas A, A', adjacent to the ends of the supports 22. The side surfaces 25, 26 of the supports 21 (and also of the supports 22) have a uniform inclination angle relative to the vertical plane (or the plane perpendicular to the surface 11). Furthermore, corresponding radii are obviously provided in the transition areas to the plane forming the surface 11.

Figure 5:
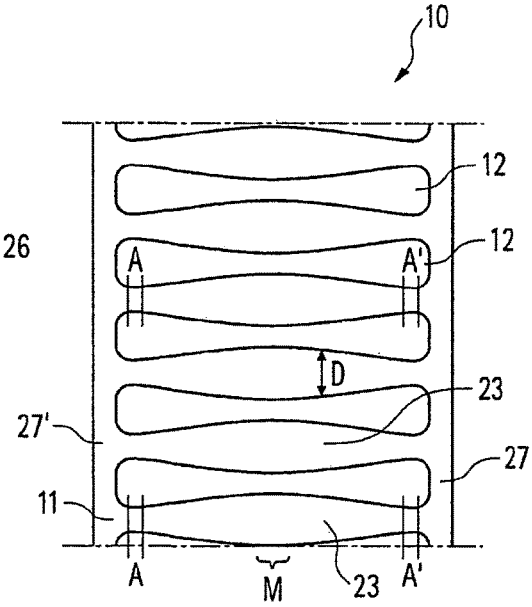
FIG. 5 shows a plan view of a cover grating for a drainage channel designed according to the invention.

The same design principle is also used in the channel cover of FIG. 5. Again, supports 23 are provided, extending between side bearings 27, 27', which rest on an upper edge of a channel (or its frame). Slots 12 through which surface water can flow into a channel beneath the cover 10 are provided between the supports 23. The "sphericity", i.e. the increased thickness D of the supports 23 in the center between the side bearings 27, 27', is magnified in FIG. 5. Again, the thickness D of the supports 23 increasing towards a central area M can once more be combined with an increased height of the supports 23, that is, a dimension perpendicular to the plane of the drawing in FIG. 5 and to the surface 11 of the cover 10.

For dimensioning the supporting structure 20, first the required thickness D of the supports 21 for a specified load of the cover 10 (largely perpendicular to the surface 11) is determined with the proviso that the support 21 has a constant thickness D. Then the load present in the areas A, A', i.e. in the area of the transitions to the radial supports 22 is determined, from which in turn the necessary thickness of a support (of constant thickness) is derived. Finally, a transition between the two thicknesses that is as uniform and crack-free as possible is derived. This results in material savings in the areas which do not have to have maximum thickness, a procedure that results in surprisingly substantial material savings.

LIST OF THE REFERENCE NUMERALS

10 cover
11 surface
12 slot
20 supporting structure
21 support
22 support
23 support
24 bottom side of the support
25, 26 side surface of the support
27, 27' side bearing

The invention claimed is:

1. A support structure of a cover, wherein the cover comprises a traversable surface and the support structure extends downwards under the cover into a structure, and the support structure comprises beam-shaped supports such that a lower support side of the beam-shaped supports facing away from the traversable surface is subject to a tensile stress when a load is applied to the traversable surface, the beam-shaped supports comprising radially-extending supports extending from an outer edge of the cover inwards, the radially-extending supports each comprising an inner end, the radially-extending supports interconnected at the inner ends by inner supports, each inner support comprising two ends and the each inner support extending from the inner end of one radially-extending support to the inner end of another radially-extending support, wherein between the ends of the inner supports a thickness (D) of the inner supports is configured to increase substantially symmetrically up to a maximum value and then decrease when viewing the inner supports of the cover from below such that the maximum value of the thickness (D) of the inner supports is in a central area (M) having a spherical shape between the two ends of each of the inner supports, wherein the inner supports and the radially-extending supports comprise side surfaces, the side surfaces of the inner supports and the radially-extending supports comprising an inclination angle relative to a plane perpendicular to the traversable surface of the cover.

2. The support structure according to claim 1, the cover is formed as an integral cast part.

3. The support structure according to claim 2, the cover is a spherulitic cast iron part.

4. The support structure according to claim 1, the beam-shaped supports having side surfaces diverging towards the traversable surface.

5. A process for dimensioning a support structure according to claim 1, the process comprising the steps of:

a first thickness of the beam-shaped supports for bearing a predetermined load is determined by assuming a constant thickness over the length of the beam-shaped support;

a second thickness of the beam-shaped supports in the areas of minimum tensile stress is determined for bearing the predetermined load based on a constant thickness over the length of the beam shaped support; and a maximum thickness of the beam-shaped supports is determined based on an increasing thickness from the second thickness to the first thickness and based on a decreasing thickness back to the second thickness.

6. The support structure according to claim 1, wherein the inclination angle of the inner supports and the radially-extending supports remains constant over the entire length of the inner supports and the radially-extending supports.

7. The support structure according to claim 1, wherein the inclination angle of the inner supports and the radially-extending supports is uniform.

* * * * *